United States Patent [19]

Nakamura et al.

[11] Patent Number: 4,912,937

[45] Date of Patent: Apr. 3, 1990

[54] AIR CONDITIONING APPARATUS

[75] Inventors: Takashi Nakamura; Kouji Ishikawa; Yoshinobu Igarashi; Hidekazu Tani, all of Wakayama, Japan

[73] Assignee: Mitsubishi Denki Kabushiki Kaisha, Tokyo, Japan

[21] Appl. No.: 325,143

[22] Filed: Mar. 17, 1989

[30] Foreign Application Priority Data

| | | | |
|---|---|---|---|
| Apr. 25, 1988 | [JP] | Japan | 63-101726 |
| Apr. 25, 1988 | [JP] | Japan | 63-101727 |
| Apr. 25, 1988 | [JP] | Japan | 63-101733 |
| Apr. 26, 1988 | [JP] | Japan | 63-104720 |
| May 18, 1988 | [JP] | Japan | 63-122380 |

[51] Int. Cl.[4] ..... F25B 13/00

[52] U.S. Cl. ..... 62/160; 62/174; 62/324.1; 62/324.6; 62/470; 62/503

[58] Field of Search ..... 62/160, 174, 156, 324.1, 62/0.6, 470, 471, 503

[56] References Cited

U.S. PATENT DOCUMENTS

| | | | |
|---|---|---|---|
| 2,590,741 | 3/1952 | Watkins | 62/174 |
| 2,966,043 | 12/1960 | Ross | 62/503 X |
| 3,315,484 | 4/1967 | Ross | 62/174 |
| 3,919,859 | 11/1975 | Ross | 62/503 X |
| 4,199,960 | 4/1980 | Adams et al. | 62/503 |
| 4,266,405 | 5/1981 | Trask | 62/503 X |
| 4,557,115 | 12/1985 | Nakamura | 62/156 |

*Primary Examiner*—Lloyd L. King

*Attorney, Agent, or Firm*—Oblon, Spivak, McClelland, Maier & Neustadt

[57] ABSTRACT

An air conditioning apparatus comprises a switching valve for switching the flowing direction of a refrigerant discharged from a compressor to carry out either cooling operation, heating operation or defrosting operation; an outdoor heat exchanger for receiving the refrigerant supplied by the compressor through the switching valve to make the refrigerant heat exchange with air to be heat exchanged; an indoor heat exchanger for making the refrigerant heat exchange with a fluid to be heat exchanged; an oil separator which is arranged in a discharging side refrigerant pipe connecting the switching valve and the discharge port of the compressor to separate the refrigerant and a refrigerating machine oil which are discharged from the compressor; a first and second accumulators which are connected in series in an intake side refrigerant pipe connecting the switching valve and the intake port of the compressor; a first bypass passage for connecting the oil separator and the second accumulator through a solenoid valve; and a second bypass passage for connecting the oil separator and the intake port of the compressor through a metering device. As a result, the refrigeranting machine oil is returned to the compressor through the first bypass passage or the first and second bypass passages to prevent the compressor from failing due to shortage of the refrigeranting machine oil.

18 Claims, 9 Drawing Sheets

AIR CONDITIONING APPARATUS

The present invention relates to a refrigeration cycle in an air conditioning apparatus, and a control device for the refrigeration cycle.

There has been provided such type of refrigeration cycle as shown in FIG. 10.

On cooling operation, a refrigerant flows as indicated in arrows of solid line in the refrigeration cycle. Specifically, the refrigerant having high temperature and high pressure, and a refrigerating machine oil which are discharged from a compressor 1 reach an outdoor heat exchanger 3 through a switching valve 2. The refrigerant carries out heat exchange to become a liquid having high temperature and high pressure. The liquid refrigerant passes through a distributor 4, is depressurized in an expansion valve 5, and comes into an indoor heat exchanger 7 through a connecting pipe 6. The liquid refrigerant is evaporated in the indoor heat exchanger 7. The evaporated refrigerant is inspired into the compressor 1 through a connecting pipe 8, the switching valve 2 and an accumulator 9. Thus, the circulating cycle is formed.

In the conventional air conditioning apparatus, when the compressor starts, foaming occurs in the refrigerant which has dissolved in the refrigerating machine oil, causing a great amount of the refrigerating machine oil to be discharged from the compressor. In addition, a small amount of the refrigerating machine oil is continuously discharged from the compressor while it is driving. The discharged refrigerating machine oil eventually returns to the intake port of the compressor 1 in accordance with the circulating cycle. However, if the connecting pipes 6 and 8 are extremely long, it would take much time for the discharged refrigerating machine oil to return to the compressor. This decreases the amount of the refrigerating machine oil in the compressor 1, resulting in poor lubrication of the compressor to create seizure at a sliding portion. In addition, when the volume in the compressor is controlled or the compressor is driven under low load, the circulating amount of the refrigerant decreases to lower the speed of the refrigerant flowing through the pipes. As a result, smooth return of the oil to the compressor is deteriorated, also resulting in poor lubrication of the compressor 1.

If the refrigerant is accumulated in an excess amount in the accumulator, the refrigerating machine oil which has come from the refrigeration circuit into the accumulator will dissolve in the refrigerant in the accumulator. This deteriorates the return of the refrigerating machine oil to the compressor, resulting in poor lubrication of the compressor 1. Such problems also occur in the heating operation wherein the switching valve is switched in a position different from that in the cooling operation to allow the refrigerant to flow as indicated in arrows of broken line.

When the outdoor heat exchanger is defrosted during the heating operation, the refrigerant flows as indicated in the arrows of solid line. Specifically, the refrigerant which is discharged from the compressor 1 and has high temperature and high pressure reaches the outdoor heat exchanger 3 through the switching valve 2. The refrigerant performs heat exchange in the outdoor heat exchanger to defrost it, and the refrigerant becomes a liquid having high temperature and high pressure. The liquid refrigerant passes through the distributor 4 and is depressurized in the expansion valve 5. After that, the refrigerant is inspired into the compressor 1 through the connecting pipe 6, the indoor heat exchanger 7, the connecting pipe 8, the switching valve 2 and the accumulator 9. The circulating cycle is formed in this way. In the defrosting operation, the fan (not shown) for the indoor heat exchanger 7 is standstill to prevent cooling air from being blown. As a result, the refrigerant which has been depressurrized in the expansion valve 5 and has low temperature and low pressure does not carry out heat exchange in the indoor heat exchanger 7. This causes the pressure of the low pressure gas to further lower. The refrigerant comes into the accumulator 9 with the pressure of the gas kept in the lower level, and the liquid refrigerant is held in the accumulator. This decreases the circulating amount of the refrigerant, causing a problem wherein the defrosting time is lengthened.

It is an object of the present invention to eliminate the disadvantage of the conventional air conditioning apparatus, and to provide a new and improved air conditioning apparatus capable of lengthening the distance between the indoor heat exchanger and the outdoor heat exchanger without trouble, and of returing the refrigerating machine oil to the compressor easily even if the volume in the compressor is varied to greatly decrease the discharging amount of the refrigerant.

The foregoing and the other objects of the present invention have been attained by providing an air conditioning apparatus comprising a switching valve for switching the flowing direction of a refrigerant discharged from a compressor to carry out either cooling operation, heating operation or defrosting operation; an outdoor heat exchanger for receiving the refrigerant supplied by the compressor through the switching valve to make the refrigerant heat exchange with air to be heat exchanged; an indoor heat exchanger for making the refrigerant heat exchange with a fluid to be heat exchanged; an oil separator which is arranged in a discharging side refrigerant pipe connecting the switching valve and the discharge port of the compressor to separate the refrigerant and a refrigerating machine oil which are discharged form the compressor; a first and second accumulators which are connected in series in an intake side refrigerant pipe connecting the switching valve and the intake port of the compressor; a first bypass passage for connecting the oil separator and the second accumulator through a solenoid valve; and a second bypass passage for connecting the oil separator and the intake port of the compressor through a metering device.

The second bypass pipe according to the present invention can be arranged to be connected to the intake port of the compressor through the second accumulator.

In accordance with the present invention, the distance between the indoor heat exchanger and the outdoor heat exchanger can be lengthened. In addition, even if the discharging amount of the refrigerant from a volume variable compressor lowers greatly, the refrigerating machine oil can return to the compressor easily.

Now, the air conditioning apparatus according to the present invention will be described in detail with reference to preferred embodiments illustrated in the accompanying drawings.

Figure 10:
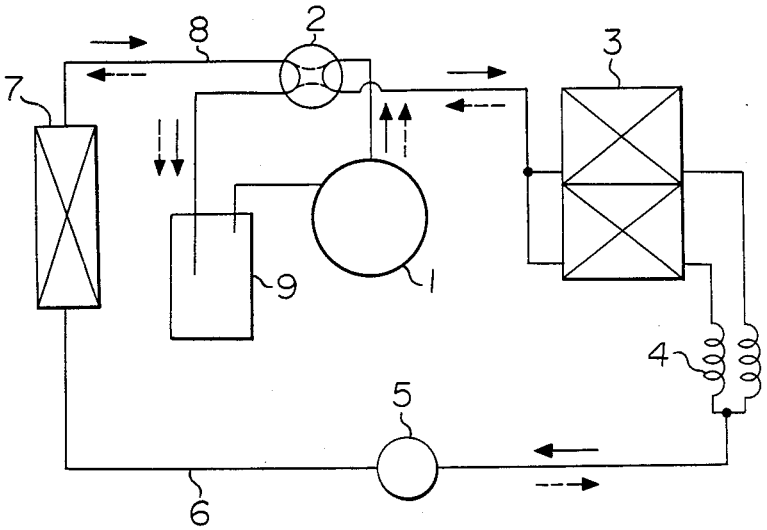
FIG. 10 is the refrigeration circuit diagram of the conventional air conditioning apparatus.

Firstly, a first embodiment of the refrigeration circuit of the present invention will be explained in reference to FIG. 1. Like the conventional refrigeration circuit as shown in FIG. 10, the refrigeration circuit according to the present invention includes a switching valve 2 for switching the flowing direction of a refrigerant discharged from a compressor 1 to carry out either cooling operation, heating operation or defrosting operation; an outdoor heat exchanger 3 for receiving the refrigerant supplied by the compressor 1 through the switching valve 2 to make the refrigerant heat exchange with air to be heat excahged; an indoor heat exchanger 7 for making the refrigerant heat exchange with a fluid to be heat exchanged; a distributor 4 and an expansion valve 5 arranged in series in a connecting pipe connecting the outdoor heat exchanger 3 and the indoor heat exchanger 7; and an accumulator (first accumulator) 9 arranged in a connecting pipe connecting the switching valve 2 and the intake port of the compressor 1. The refrigeration circuit according to the present invention also includes an oil separator 10, a first bypass pipe 11, a solenoid valve 12, a second accumulator 13, a second bypass pipe 14, a metering device (a capillary tube in the embodiment) 15, a connecting pipe 16 connecting the first and second accumulators 9 and 13, and an intake side refrigeration pipe 17 connecting the second accumulator 13 and the intake port of the compressor 1.

Figure 1:
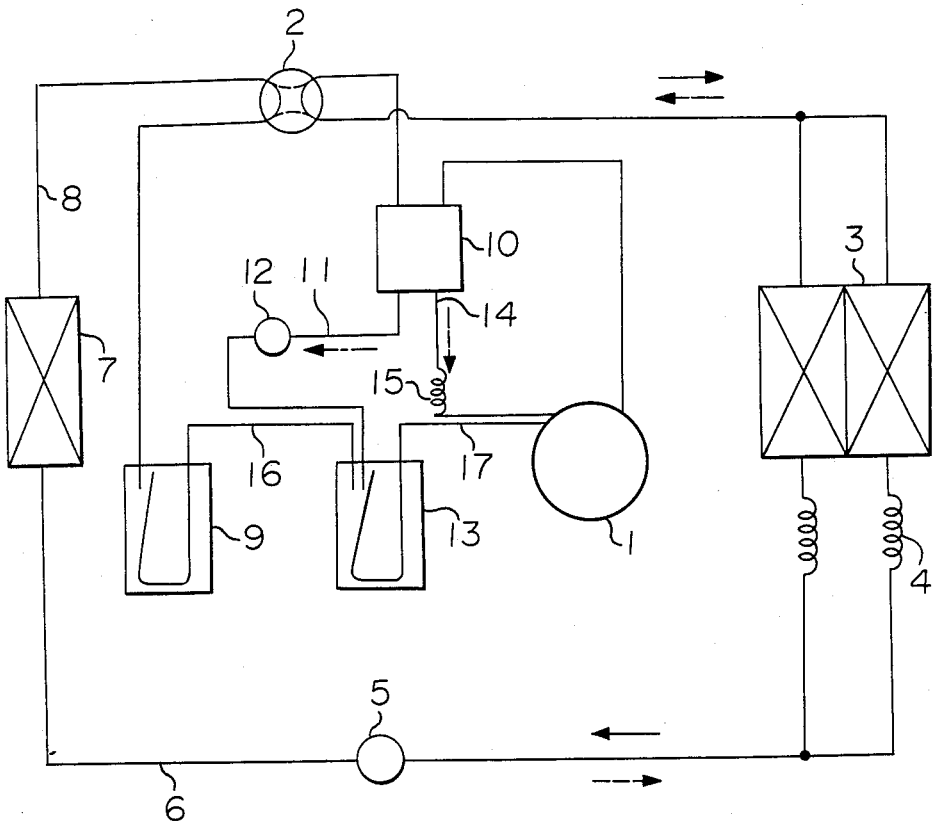
FIG. 1 is a refrigeration circuit diagram of a first embodiment of the air conditioning apparatus according to the present invention.

Specifically, as shown in FIG. 1, the oil separator 10 is arranged between the discharge port of the compressor 1 and the switching valve 2. The first bypass pipe 11 is arranged to extend from the oil separator 10 to the second accumulator 13 through the solenoid valve 12. In addition, the second bypass pipe 14 is arranged to extend from the oil separator 10 to the intake port of the compressor 1 through the metering device such as a capillary tube 15.

The operation of the refrigeration circuit of the first embodiment will be explained.

In FIG. 1, arrows of solid line indicate the flow of the refrigerant in the cooling operation and the defrosting operation, whereas arrows of broken line indicate the flow of the refrigerant in the heating operation. Arrows of alternate long and short dash line indicate the flow of the refrigerant and the refrigerating machine oil in the bypass pipes.

In the cooling operation, the refrigerant and the refrigerating machine oil which have been discharged from the compressor 1 and have high temperature and high pressure come into the oil separator 10 from the top, the refrigerating machine oil is separated from the refrigerant, and it is stored in the bottom within the oil separator 10. The gaseous refrigerant which has been separated from the refrigerating machine oil goes out of the top of the oil separator 10 and reaches the outdoor heat exchanger 3 through the switching valve 2. In the outdoor heat exchanger, the refrigerant performs heat exchange to become the liquid having high temperature and high pressure. The liquid refrigerant passes through the distributor 4 and is depressurized in the expansion valve 5. The refrigerant reaches the indoor heat exchanger 7 through a connecting pipe 6 connecting the expansion valve 5 and the indoor heat exchanger 7. The refrigerant is evaporated in the indoor heat exchanger 7. The refrigerant passes a connecting pipe 8 connecting the indoor heat exchanger 7 and the switching valve 2, and returns to the compressor 1 through the switching valve 2, the first accumulator 9 and the second accumulator 13.

During the cooling operation, the metering device such as the capillary tube 15 which is arranged in the second bypass pipe 14 allows the refrigerating machine oil to continuously flow in an amount which is balanced against the discharging amount of the refrigerating machine oil normally discharged from the compressor 1.

Thus, the refrigerating machine oil is continuously returned to the compressor 1 through the second bypass pipe 14. In addition, if the refrigerating machine oil is discharged from the compressor 1 in an amount greater than the amount of the refrigerating machine oil which flows through the second bypass pipe 14, and a large amount of the refrigerting machine oil is accordingly stored in the oil separator 10, the solenoid valve 12 in the first bypass pipe 11 receives a signal and opens to return the refrigerating machine oil to the second accumulator 13 through the first bypass pipe 11 as well though the solenoid valve 12 is normally closed.

The refrigerating machine oil which has been accumulated in the bottom within the oil separator 10 flows into the second accumulator 13 in this way. The refrigerating machine oil in the second accumulator returns to the compressor 1 together with the gaseous refrigerant which has come from the indoor heat exchanger 7 and has low temperature and low pressure, allowing the circulating circuit of the refrigerating machine oil to be shortened greatly.

The refrigerating machine oil which comes from the first bypass pipe does not return directly to the compressor, but it comes into the second accumulator 13 and then gradually returns to the compressor 1. This prevents oil hammer from occuring in the compressor 1 to break a valve and so on. In addition, an excess liquid refrigerant in the refrigeration circuit gradually comes into the second accumulator 13 after it has come into the first accumulator 9. As a result, the amount of the liquid refrigerant in the second accumulator 13 is remarkably small than that in the first accumulator. The refrigerating machine oil which returns from the oil separator 10 through the first bypass pipe 11 and the second bypass pipe 14 returns to the compressor quickly without being thinned with the excessive liquid refrigerant. This prevents seizure at a bearing portion from occuring due to the shortage of the refrigerating machine oil.

On the other hand, in the heating operation, the switching valve 2 is switched to form the circuit as indicated in broken lines. The refrigerant and the refrigerating machine oil which have been discharged from the compressor 1 and have high temperature and high pressure are separated in the oil separator 10. The gaseous refrigerant reaches the indoor heat exchanger 7 through the switching valve 2 and the connecting pipe 8. In the indoor heat exchanger 7, the gaseous refrigerant becomes the liquid refrigerant having high temperature and high pressure. The liquid refrigerant passes through the connecting pipe 6, and is depressurrized in the expansion valve 5. The liquid refrigerant flows into the outdoor heat exchanger 3 through the distributor 4. In the outdoor heat exchanger 3, the liquid refrigerant becomes the gaseous refrigerant having low pressure. After that, the gaseous refrigerant returns to the compressor 1 through the switching valve 2, the first accumulator 9 and the second accumulator 13. The metering device 15 which is arranged in the second bypass pipe 14 allows the refrigerating machine oil discharged from the compressor 1 to be continuously returned to the compressor 1.

In consequence, even if the distance between an indoor heat exchanger unit and an outdoor heat exchanger unit with the compressor 1, the switching valve 2 and other parts mounted in it is great, i.e. the connecting pipes 6 and 8 are long, the short bypass pipe forming circulating circuit for the refrigerating machine oil prevents the compressor 1 from being short of the refrigerating machine oil. Even if a great amount of the refrigerating machine oil is discharged depending on operating conditions, the first bypass pipe 11 having a short length allows the refrigerating machine oil to be rapidly returned to the compressor 1 through the solenoid valve 12, preventing the compressor 1 from being short of the refrigerating machine oil.

In the case of a volume control type of compressor, even if the circulating amount of the refrigerant discharged from the compressor is greatly decreased to a small value, i.e. the refrigerant speed moving in the refrigerant pipes become small, insufficient return of the refrigerating machine oil will not occur because the length of the circuit with the refrigerating machine oil circulating is unchanged and remains short.

The refrigerant which has dissolved in the refrigerating machine oil while the compressor 1 is standstill causes foaming when the compressor starts. This results in increased discharge of the refrigerating machine oil and the liquid refrigerant from the compressor 1 in comparison with those in a normal successive operation. The refrigerating machine oil and the liquid refrigerant which have been discharged in the greater amount are separated in the oil separator. When the solenoid valve 12 is kept opened for a predetermined time (for example 1 minute) after the compressor starts, the refrigerating machine oil returns to the compressor 1 together with the gaseous refrigerant having low pressure, through the second bypass pipe 14 having low flow rate, and through the first bypass pipe 11 having high flow rate and the second accumulator 13 without circulating in the refrigerant circuit, allowing the shortage of the refrigerating machine oil to be compensated for in a short time. A great amount of the liquid refrigerant which has been accumulated in the oil separator flows out from the first bypass pipe 11 and the second bypass pipe 14 together with the refrigerating machine oil. The liquid refrigerant and refrigerating machine oil which flow out from the first bypass pipe 11 in such great amount come into the second accumulator 13 without returning directly to the compressor 1. After that, the liquid refrigerant and the refrigerating machine oil gradually return to the compressor 1. This prevents the liquid hammer from occuring in the compressor to break the valve and so on. In addition, this arrangement prevents the liquid refrigerant from thinning the refrigeranting machine oil, allowing the seizure at the bearing portion and so on to be avoided.

When the heating operation is shifted to the defrosting operation, the switching valve 2 is switched so that the gaseous refrigerant which has been compressed in the compressor 1 and has high temperature and high pressure is supplied to the outdoor heat exchanger 3 through the oil separator 10 and the switching valve 2. The refrigerant carries out defrosting in the outdoor heat exchanger 3, passes through the distributor 4 and is decompressed in the expansion valve 5. After that, the refrigerant passes through the connecting pipe 6, the indoor heat exchanger 7, the connecting pipe 8 and the switching valve 2, and returns to the second accumulator 13. The gaseous refrigerant which has been discharged from the compressor 1 and has high temperature and high pressure is also returned from the bottom of the oil separator 10 to the second accumulator 13 through the first bypass pipe 11. In the second accumulator 13, the gaseous refrigerant which has passed through the indoor heat exchanger 7 and has low temperature and low pressure, and the gaseous refrigerant which has passed through the first bypass pipe 11 and has high temperature and high pressure are mixed so that the pressure of the lower pressure gas is raised. The mixed gaseous refrigerant is returned to the compressor 1. As a result, an operational state wherein specific volume is small and the circulating amount is great can be realized to defrost frost formed on the outdoor heat exchanger 3 in a short time.

Since there is a possibility that the frost is rapidly formed in the heating operation when the outside air temperature is low, the solenoid valve 12 is opened again to cause the first bypass pipe 11 to conduct. In this way, a portion of discharged gas having high temperature is bypassed to the second accumulator 13 for mixture, thereby improving heating capability at such low outside air temperature.

In the case of a volume variable compressor, during the defrosting operation or during the heating operation at the time of low outside air temperature, the capability of the compressor is made maximum when the solenoid valve 12 is opened. This allows defrosting capability or heating capability to be improved.

If the refrigerating machine oil is discharged from the compressor 1 in an amount which is greater than the amount of the refrigerating machine oil which is returned to the compressor 1 from the oil separator 10 through the metering device such as the capillary tube 15 and the second bypass pipe 14, the solenoid valve 12 is opened in a predetermined time (for example 60 minutes) after the compressor 1 has started. As a result, the refrigerating machine oil which has been separated and accumulated in the oil separator 10 is returned to the second accumulator 13 through the first bypass pipe 11 as well. The refrigerating machine oil is returned to the compressor 1 together with the gaseous refrigerant which has come from the indoor heat exchanger 7 and has low temperature and low pressure, preventing the compressor 1 from being short of the refrigerating machine oil.

Figure 2:
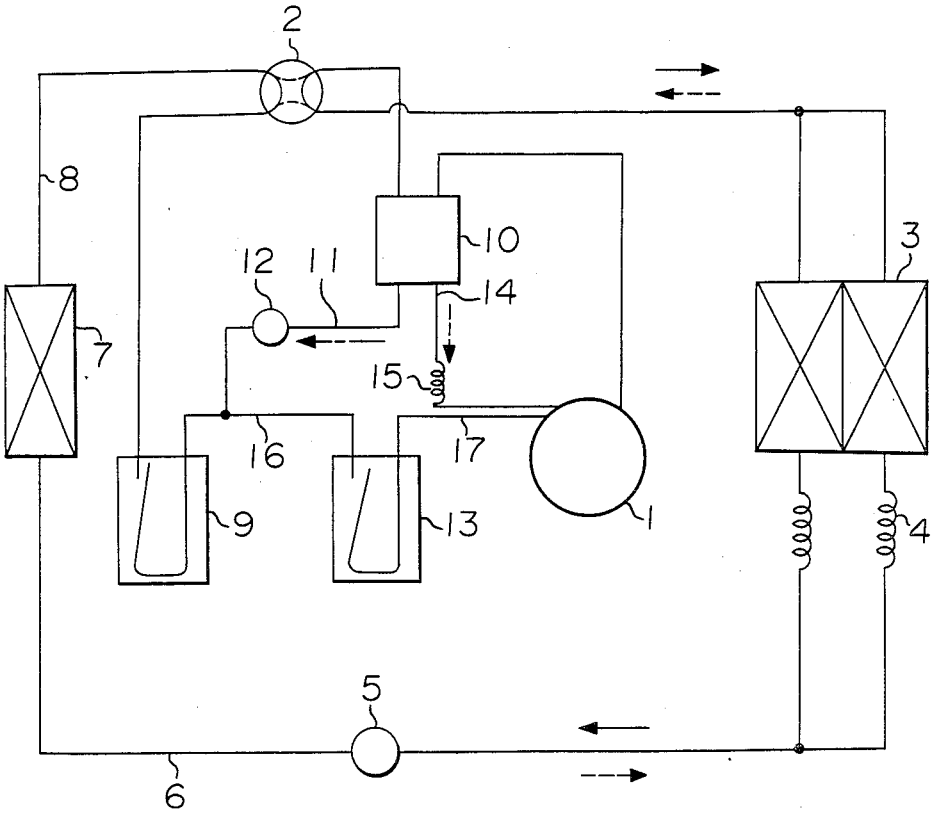
FIG. 2 is a refrigeration circuit diagram of a second embodiment of the air conditioning apparatus according to the present invention.

A second embodiment of the refrigerating circuit according to the present invention will be described in reference to FIG. 2.

The second embodiment is different from the first embodiment in that the first bypass pipe 11 is connected to the second accumulator 13 through the connecting pipe 16 connecting the first and second accumulators 9 and 13. In the second embodiment like the first embodiment, when the refrigerating machine oil is accumulated in the oil separator 10 in an amount greater than the amount of the refrigerating machine oil which flows through the second bypass pipe 14, the solenoid valve 12 is opened based on a signal. As a result, the refrigerating machine oil is returned from the oil separator 10 to the second accumulator 13 through the first bypass pipe 11 and the connecting pipe 16.

Figure 3:
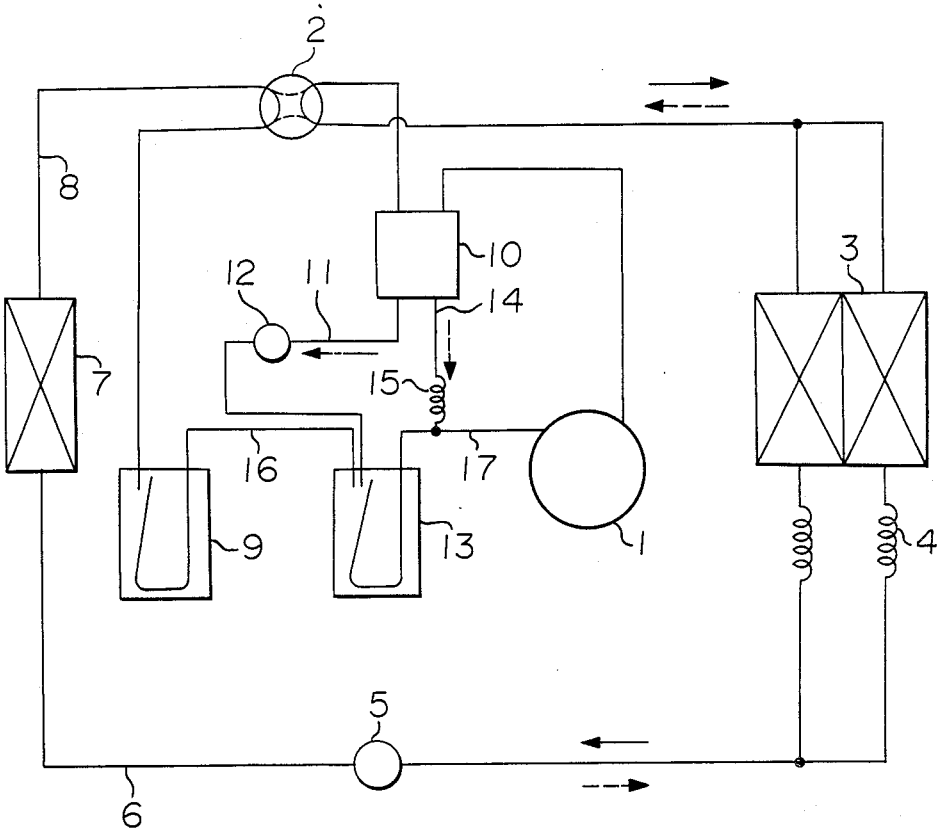
FIG. 3 is a refrigeration circuit diagram of a third embodiment of the air conditioning apparatus according to the present invention.

A third embodiment of the refrigeration circuit according to the present invention will be explained in reference to FIG. 3.

The third embodiment is different from the first embodiment in that the second bypass pipe 14 is connected to the intake side refrigeration pipe 17 connecting the second accumulator 13 and the compressor 1, and thus the second bypass pipe communicates with the intake port of the compressor 1 through the intake side refrigeration pipe 17. In the third embodiment like the first and second embodiments, the metering device 15 in the second bypass pipe 14 allows the refrigerating machine oil to flow in an amount which is balanced against the discharging amount of the refrigerating machine oil normally discharged from the compressor 1. In this way, the refrigerating machine oil is continuously returned to the compressor 1 through the intake side refrigeration pipe 17.

Figure 4:
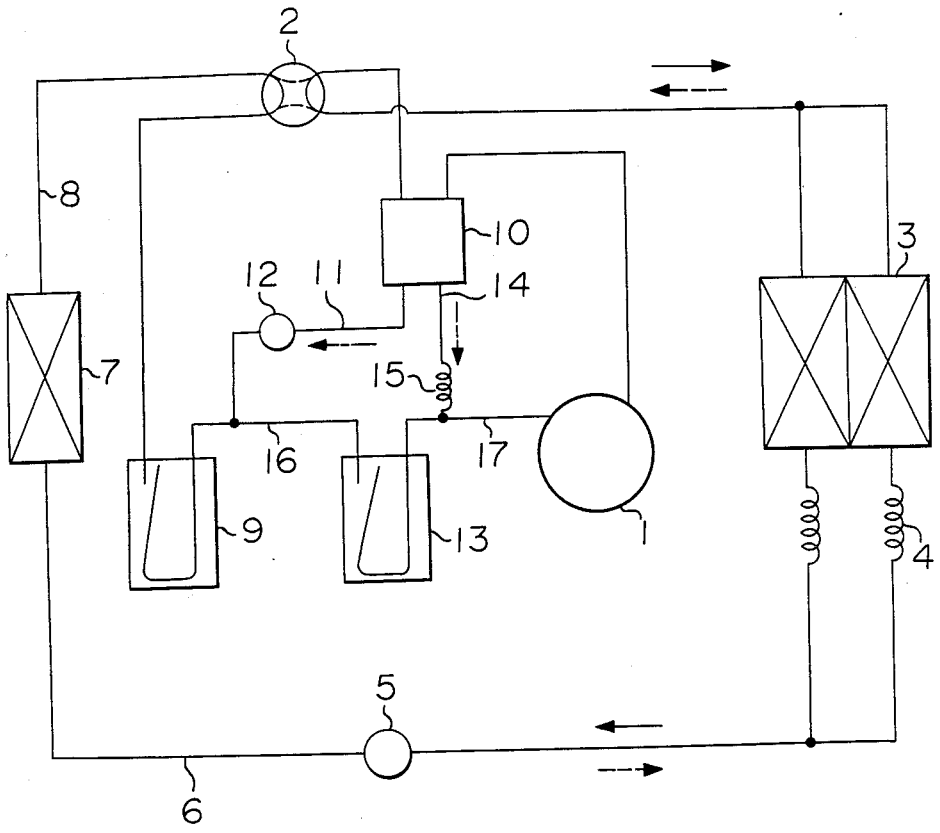
FIG. 4 is a refrigeration circuit diagram of a forth embodiment of the air conditioning apparatus according to the present invention.

A fourth embodiment of the refrigeration circuit according to the present invention will be described in reference to FIG. 4. The fourth embodiment is different from the first embodiment in that the first bypass pipe 11 is connected to the second accumulator 13 through the connecting pipe 16 connecting the first and second accumulators 9 and 13, and that the second bypass pipe 14 is connected to the intake side refrigeration pipe 17 connecting the second accumulator 13 and the intake port of the compressor 1, and the second bypass pipe thus communicates with the intake port of the compressor 1 through the intake side refrigeration pipe 17. In the fourth embodiment, the route of the refrigerating machine oil flowing from the first bypass pipe 11 to the compressor 1 and that of the refrigerating machine oil flowing from the second bypass pipe 14 to the compressor 1 are similar to those in the second and third embodiments, respectively.

Figure 5:
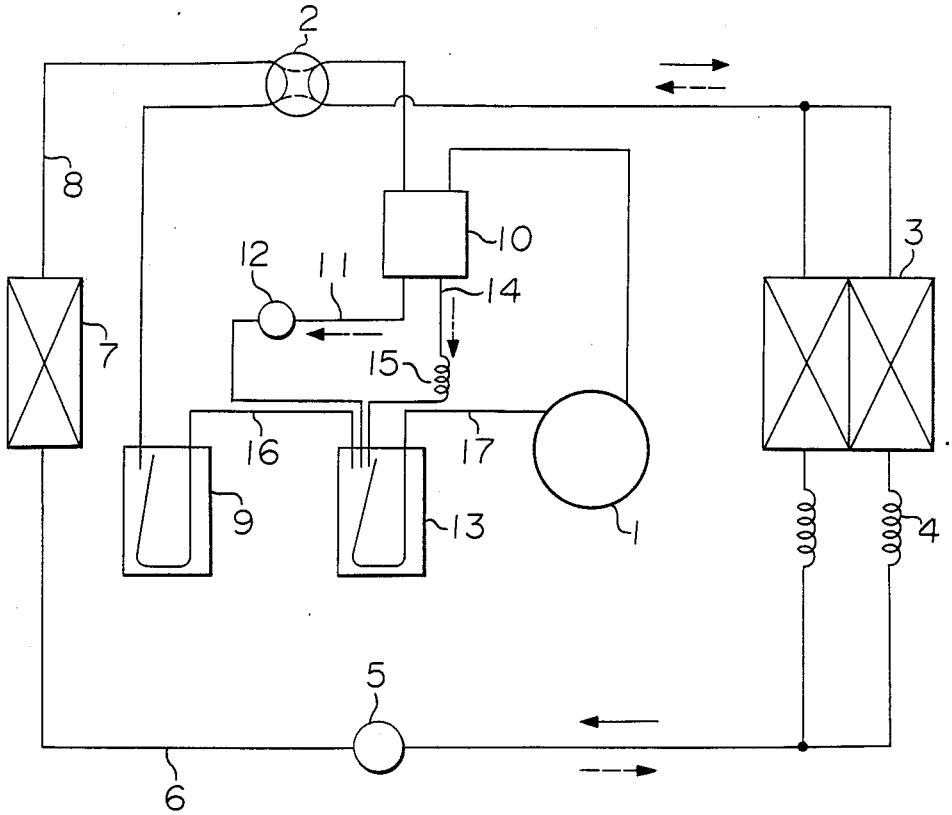
FIG. 5 is a refrigeration circuit diagram of a fifth embodiment of the air conditioning apparatus according to the present invention.

A fifth embodiment of the refrigeration circuit according to the present invention will be described in reference to FIG. 5.

The fifth embodiment is different from the first embodiment in that the second bypass pipe 14 connects between the oil separator 10 and the second accumulator 13.

In the fifth embodiment like the first to fourth embodiments, the metering device 15 in the second bypass pipe 14 allows the refrigerating machine oil to continuously flow in an amount which is balanced against the discharging amount of the refrigerating machine oil normally discharged from the compressor 1. In this way, the refrigerating machine oil is continuously returned to the compressor 1 through the second accumulator 13 and the intake side refrigeration pipe 17.

Figure 6:
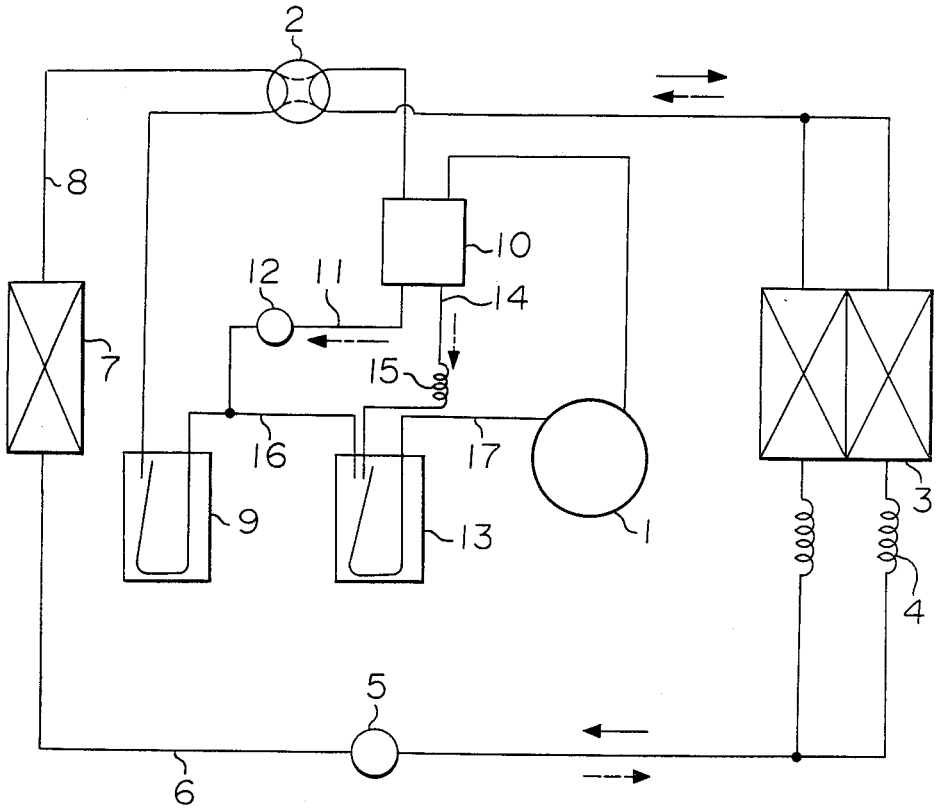
FIG. 6 is a refrigeration circuit diagram of a sixth embodiment of the air conditioning apparatus according to the present invention.

A sixth embodiment of the refrigeration circuit according to the present invention will be explained with reference to FIG. 6.

The sixth embodiment is different from the fifth embodiment in that the first bypass pipe 11 is connected to the second accumulator 13 through the connecting pipe 16 connecting the first and second accumulators 9 and 13. In the sixth embodiment, when the refrigerating machine oil is accumulated in the oil separator 10 in an amount which is greater that the amount of the refrigerating machine oil which flows through the second bypass pipe 14, the solenoid valve 12 is opened based on a signal like the first to fifth embodiments. As a result, the refrigerating machine oil is returned from the oil separator 10 to the second accumulator 13 through the first bypass pipe 11 and the connecting pipe 16, in addition to through the second bypass pipe 14.

Figure 7:
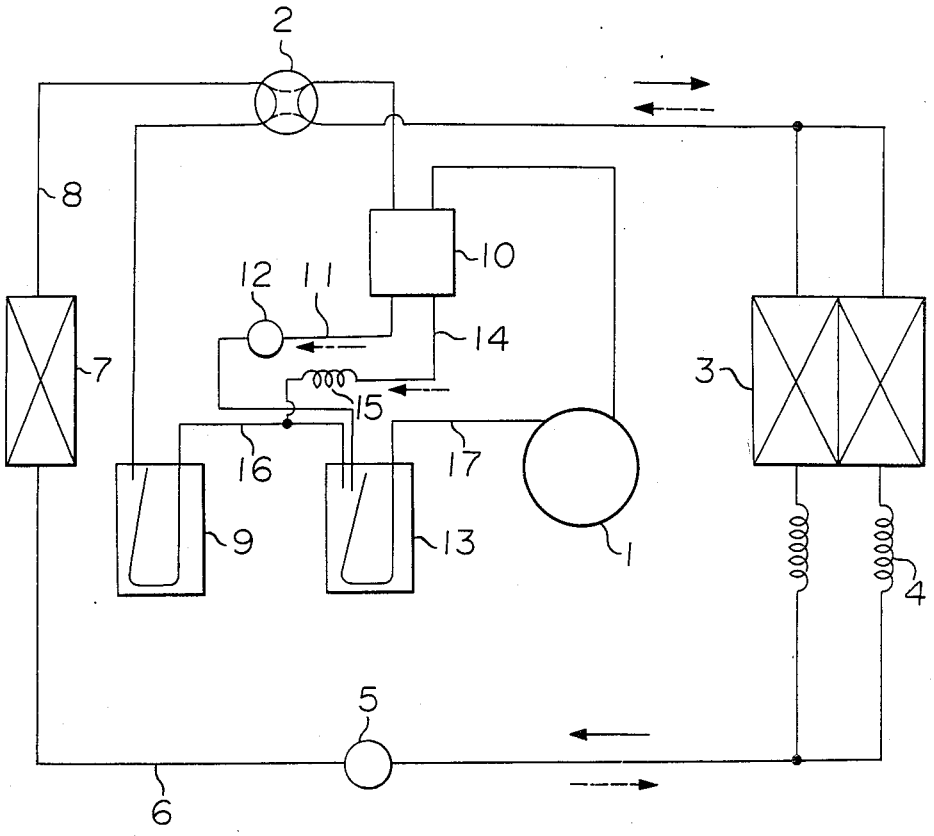
FIG. 7 is a refrigeration circuit diagram of a seventh embodiment of the air conditioning apparatus according to the present invention.

A seventh embodiment of the refrigeration circuit according to the present invention will be explained in reference to FIG. 7. The seventh embodiment is different from the first embodiment in that the second bypass pipe 14 is connected to the second accumulator 13 through the connecting pipe 16 connecting the first and second accumulators 9 and 13. In the seventh embodiment like the first to sixth embodiments, the metering device 15 in the second bypass pipe 14 allows the refrigerating machine oil to continuously flow in an amount which is balanced against the discharging amount of the refrigerating machine oil normally discharged from the compressor 1. In this way, the refrigerating machine oil is continuously returned to the compressor 1 through the connecting pipe 16, the second accumulator 13 and the intake side refrigeration pipe 17.

Figure 8:
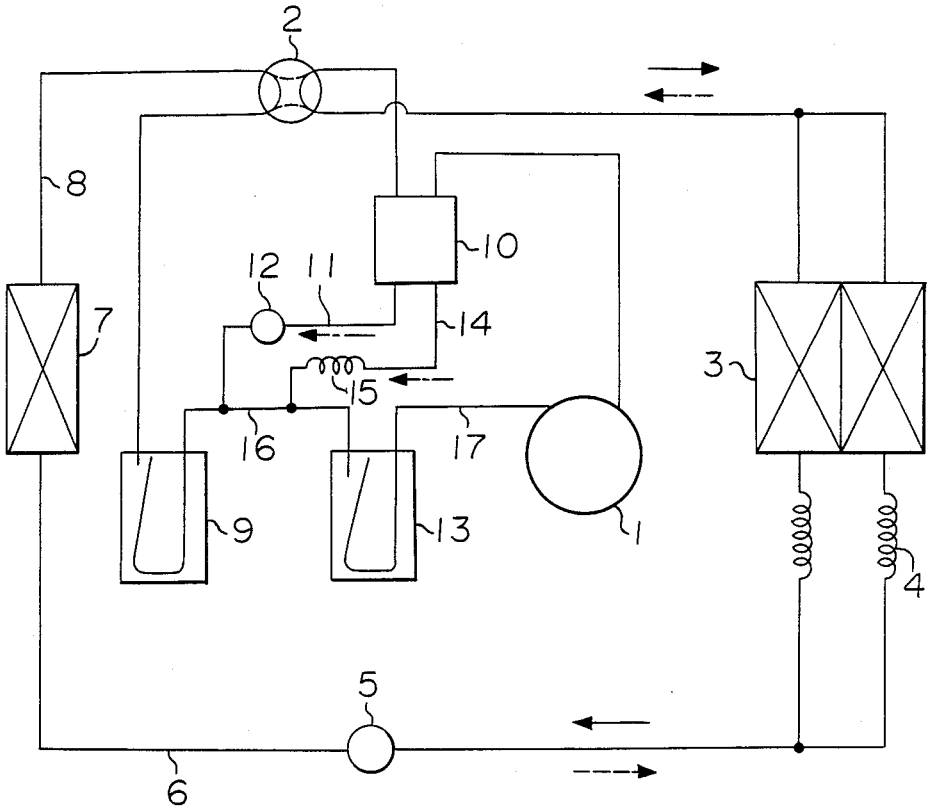
FIG. 8 is a refrigeration circuit diagram of a eighth embodiment of the air conditioning apparatus according to the present invention.

An eighth embodiment of the refrigeration circuit according to the present invention will be explained in reference to FIG. 8.

The eighth embodiment is different from the first embodiment in that the first bypass pipe 11 is connected to the second accumulator 13 through the connecting pipe 16 connecting the first and second accumulators 9 and 13, and that the second bypass pipe 11 is connected to the second accumulator 13 through the same connecting pipe 16 connecting the first and second accumulators 9 and 13.

In the eighth embodiment, the flowing route of the refrigerating machine oil from the first bypass pipe 11 to the compressor 1 and that from the second bypass pipe 14 to the compressor 1 are similar to those in the sixth and seventh embodiments, respectively.

The first through eighth embodiments have been explained in reference to a spirit type of air conditioning apparatus wherein the compressor 1 is outside a room. The present invention is also applicable to a remote type of air conditioning apparatus wherein the compressor 1 is in a room. In addition, the first through eighth embodiments utilize the expansion valve as the throttle device. The throttling device can be in the form of a capillary tube, an electric type of expansion valve or an orifice. The throttling device can be arranged at any position in a pipe between the indoor heat exchanger and the outdoor heat exchanger.

As explained, the refrigeration circuit according to the present invention offers many advantages as follows:

The length of the connecting pipes 6 and 8, i.e. the distance between the indoor heat exchanger and the outdoor heat exchanger can be remarkably lengthened without trouble. Even if the discharging amount of the refrigerant from the volume variable compressor is greatly reduced, the refrigerating machine oil can be easily returned to the compressor. When the discharging amount of the refrigerating machine oil is increased, the solenoid valve 12 is opened to allow the refrigerating machine oil to be rapidly returned to the compressor 1 through the first bypass pipe 11, in addition to the second accumulator 13. As a result, the flow rate in the second bypass pipe which continuously conducts through the metering device such as the capillary tube can be minimized, preventing the capability of the compressor from being lowered, and allowing the refrigerating machine oil to be continuously returned directly to the compressor. This arrangement does not return the refrigerating machine oil and the liquid refrigerant to the compressor in great amounts at a time, preventing the compressor from being damaged. The series connection of the first and second accumulators can accumulate in the first accumulator upstream to the second accumulator an excessive liquid refrigerant produced depending on operating conditions. As a result, the excessive refrigerant is little accumulated in the second accumulator downstream to the first accumulator. In this way, the refrigerating machine oil which comes into the second accumulator from the first and/or the second bypass pipe can return to the compressor rapidly without being thinned by the liquid refrigerant, thereby preventing the compressor from being damaged. Thus, the present invention can provide in a simple and an economical form an air conditioning apparatus wherein reliability is not deteriorated even if the connecting pipe 8 or other pipe is lengthened.

Next, a preferred embodiment of the control device utilized for the refrigeration circuit according to the present invention will be described in detail in reference to FIG. 9.

Figure 9:
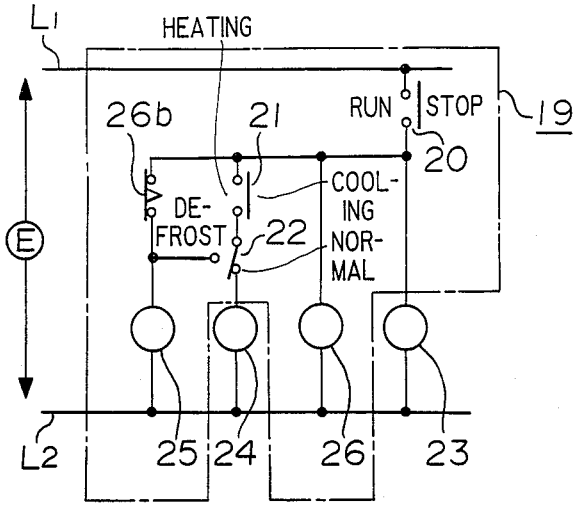
FIG. 9 is an electrical circuit diagram of the essential parts of an embodiment of the control device utilize for the refrigeration circuit of the air conditioning apparatus according to the present invention.

In FIG. 9, reference numeral 19 designates control means for turning the solenoid valve 12 on and off. Between power lines $L_1$ and $L_2$ of an ac power source E, a compressor driving switch 20 for turning the compressor 1 on and off, and an electromagnetic contactor 23 for the compressor 1 are connected. Reference numeral 26 designates a delay timer which is connected in parallel with the electromagnetic contactor 23 and has normally closed delay contacts **26*b*. Reference numeral 21 designates a cooling and heating switch which is closed on heating and is opened on cooling. Reference numeral 22 designates defrost output contacts which constitute a series circuit with the switch 21 on normal heating operation to energize a switching valve coil 24, and which constitute a series circuit with the switch 21 on the defrosting operation to energize a solenoid valve coil 25. In this arrangement, when the compressor driving switch 20 is closed with the cooling and heating switch 21 opened at the time of cooling operation, the delay timer 26 is energized to start counting the predetermined time (for example 1 minute). While the delay timer 26 is counting, the solenoid valve coil 25 is energized through the compressor driving switch 20 and the normally closed delay contacts 26*b* to open the solenoid valve 12. When the delay timer 26 has completed the predetermined time count, the normally closed delay contacts 26*b* are opened to deenergize the solenoid valve coil 25, thereby closing the solenoid valve 12. After that, the compressor 1 is continuously driven with the solenoid valve 12** closed.

When the cooling and heating switch 21 and the compressor driving switch 20 are closed at the time of heating operation, the switching valve coil 24 is energized through the switches 20 and 21, and the contacts 22 to switch the switching valve 2 to the heating operation cycle. In this case, the solenoid valve 12 is opened only for the predetermined time at the time of starting the apparatus because the solenoid valve coil 25 is energized only for the set time of the delay timer 26 like the cooling operation after the electromagnetic contactor 23 of the compressor 1 has been energized. When much frost is formed on the outdoor heat exchanger 3 during the heating operation, the defrost output contacts 22 are switched to deenergize the switching valve coil 24, thereby changing the refrigeration circuit to the cooling operation cycle. In addition, the solenoid valve coil 25 is energized through the switches 20 and 21, and the defrost output contacts 22 to open the solenoid valve 12. When the defrosting operation has been completed, the defrost output contacts 22 are returned to energize the switching valve coil 24 and to deenergize the solenoid valve coil 25, thereby returning the refrigeration circuit to the normal heating operation cycle again.

In this way, the solenoid valve 12 is opened for the predetermined time when the compressor 1 is started. Even if the foaming function of the refrigerant which has dissolved in the refrigerating machine oil during the stoppage of the compressor causes the refrigerating machine oil to be discharged in a great amount, the refrigerating machine oil which is accumulated in the oil separator 10 flows into the second accumulator 13 through the first bypass pipe 11 as well, and returns to the compressor 1 in a short time. The liquid refrigerant which is accumulated in the oil separator 10 together with the refrigerating machine oil is also flowed into the second accumulator 13 through the first bypass pipe 11 without being returned directly to the compressor 1. In this way, the liquid refrigerant is gradually returned to the compressor, preventing the compressor 1 from failing due to liquid hammer and so on.

In addition, during a normal operation, the refrigerating machine oil discharged from the compressor 1 is returned to the intake port of the compressor 1 through the second bypass pipe 14, preventing the compressor 1 from being short of the refrigerating machine oil even if the connecting pipes 6 and 8 are long. The excessive refrigerant in the refrigerant circuit flows into the first accumulator 9, and then it moves to the second accumulator 13. This arrangement lessens the accumulating amount in the second accumulator 13 in comparison with that in the first accumulator 9. As a result, the refrigerating machine oil which flows in a great amount from the oil separator 10 into the second accumulator 13 through the first bypass pipe 11 is returned to the compressor 1 without being thinned by the liquid refrigerant, eliminating the seizure at a bearing portion and so on caused by the shortage of the refrigerating machine oil.

Further, when the defrosting operation is carried out at the time of the heating operation, the switching valve 2 is switched, causing the refrigerant having high pressure in the indoor heat exchanger 7 to flow into the first accumulator 9 promptly, and the liquid refrigerant could flow directly into the first accumulator 9 depending on operating conditions. Even in that case, the second accumulator 13 recovers the liquid refrigerant without returning the liquid refrigerant directly to the compressor 1, preventing the compressor 1 from being damaged. The foaming of the refrigerant which has dissolved in the refrigerating machine oil occurs immediately after the defrosting operation starts, because the pressure in the compressor 1 is rapidly lowered at that time. As a result, the refrigerating machine oil flows into the oil separator 10 in a great amount. However, the solenoid valve 12 is opened to return most of the refrigerating machine oil to the second accumulator 13 through the first bypass pipe 11, preventing a shortage of the oil from occuring. In addition, during the defrosting operation, the gaseous refrigerant having high temperature and high pressure is supplied to the second accumulator 13 through the solenoid valve 12 together with the refrigerating machine oil to raise the pressure in the second accumulator, decreasing specific volume of the gaseous refrigerant inspired into the compressor 1. As a result, the work by the compressor 1 is increased, resulting short completion of the defrosting operation.

As explained, the control device utilized for the refrigerant circuit according to the present invention opens the solenoid valve in the first bypass pipe for the predetermined time when the compressor starts. As a result, even if the foaming of the refrigerant which is generated at the time of starting the compressor causes the refrigerating machine oil to be discharged in a great amount, the oil can be recovered rapidly. In addition, the recovered refrigerating machine oil and liquid refrigerant are supplied into the second accumulator once without rapidly returning the refrigerating machine oil and the liquid refrigerant to the compressor, thereby preventing the compressor from being damaged due to oil hammer or liquid hammer. This can realize the air conditioning apparatus having high reliability.

The solenoid valve in the first bypass pipe is opened during the defrosting operation to mitigate against rapid lowering of the pressure in a low level during the defrosting operation, improving defrosting capability. Thus, the defrosting time can be shortened to establish energy saving. In addition, the refrigerating machine oil which is rapidly discharged from the compressor due to a decrease in pressure in the compressor can be recovered effectively to prevent the compressor from being short of the refrigerating machine oil. Even if overflow occurs in the first accumulator because of a rapid liquid back phenomenon, the second accumulator can recover the liquid refrigerant to prevent the liquid refrigerant from returning directly to the compressor.

What is claimed is:

1. An air conditioning apparatus comprising:

a switching valve for switching the flowing direction of a refrigerant discharged from a compressor to carry out either cooling operation, heating operation or defrosting operation;

an outdoor heat exchanger for receiving the refrigerant supplied by the compressor through the switching valve to make the refrigerant heat exchange with air to be heat exchanged;

an indoor heat exchanger for making the refrigerant heat exchange with a fluid to be heat exchanged;

an oil separator which is arranged in a discharging side refrigerant pipe connecting the switching valve and the discharge port of the compressor to separate the refrigerant and a refrigerating machine oil which are discharged from the compressor;

a first and second accumulators which are connected in series in an intake side refrigerant pipe connecting the switching valve and the intake port of the compressor;

a first bypass passage for connecting the oil separator and the second accumulator through a solenoid valve; and a second bypass passage for connecting the oil separator and the intake port of the compressor through a metering device.

2. An air conditioning apparatus according to claim 1, wherein the first bypass passage is connected to the second accumulator through a connecting pipe connecting the first and second accumulators.

3. An air conditioning apparatus according to claim 1, wherein the second bypass passage is connected to the intake port of the compressor through the intake side refrigerant pipe connecting the second accumulator and the intake port of the compressor.

4. An air conditioning apparatus according to claim 2, wherein the second bypass passage is connected to the intake port of the compressor through the intake side refrigerant pipe connecting the second accumulator and the intake port of the compressor.

5. An air conditioning apparatus according to claim 1, wherein the second bypass passage is connected to the intake port of the compressor through the second accumulator, and the intake side refrigerant pipe connecting the second accumulator and the intake port of the compressor.

6. An air conditioning apparatus according to claim 2, wherein the second bypass passage is connected to the intake port of the compressor through the second accumulator, and the intake side refrigerant pipe connecting the second accumulator and the intake port of the compressor.

7. An air conditioning apparatus according to claim 1, wherein the second bypass passage is connected to the intake port of the compressor through the connecting pipe connecting the first and second accumulators, the second accumulator, and the intake side refrigerant pipe connecting the second accumulator and the intake port of the compressor.

8. An air conditioning apparatus according to claim 2, wherein the second bypass passage is connected to the intake port of the compressor through the connecting pipe connecting the first and second accumulators, the second accumulator, and the intake side refrigerant pipe connecting the second accumulator and the intake port of the compressor.

9. An air conditioning appararus according to claim 1, wherein the flow rate in the first bypass passage is set to be greater than that in the second bypass passage.

10. An air conditioning appararus according to claim 2, wherein the flow rate in the first bypass passage is set to be greater than that in the second bypass passage.

11. An air conditioning appararus according to claim 3, wherein the flow rate in the first bypass passage is set to be greater than that in the second bypass passage.

12. An air conditioning appararus according to claim 4, wherein the flow rate in the first bypass passage is set to be greater than that in the second bypass passage.

13. An air conditioning appararus according to claim 5, wherein the flow rate in the first bypass passage is set to be greater than that in the second bypass passage.

14. An air conditioning appararus according to claim 6, wherein the flow rate in the first bypass passage is set to be greater than that in the second bypass passage.

15. An air conditioning appararus according to claim 7, wherein the flow rate in the first bypass passage is set to be greater than that in the second bypass passage.

16. An air conditioning appararus according to claim 8, wherein the flow rate in the first bypass passage is set to be greater than that in the second bypass passage.

17. An air conditioning apparatus according to claim 1, wherein there is provided control means for opening the solenoid valve during a predetermined time after the compressor has started.

18. An air conditioning apparatus according to claim 17, wherein the control means is constructed to continuously open the solenoid valve in the first bypass passage during the defrosting operation.

* * * * *